US006328101B1

(12) United States Patent
Friis

(10) Patent No.: US 6,328,101 B1
(45) Date of Patent: Dec. 11, 2001

(54) IMPACT ENHANCING TOOL

(75) Inventor: Niels Christian Olaf Friis, Aberdeenshire (GB)

(73) Assignee: International Petroleum Equipment Limited, Inverurie (GB)

( * ) Notice: Subject to any disclaimer, the term of this patent is extended or adjusted under 35 U.S.C. 154(b) by 0 days.

(21) Appl. No.: 09/485,200

(22) PCT Filed: Aug. 7, 1998

(86) PCT No.: PCT/GB98/02388

§ 371 Date: Feb. 4, 2000

§ 102(e) Date: Feb. 4, 2000

(87) PCT Pub. No.: WO99/09295

PCT Pub. Date: Feb. 25, 1999

(30) Foreign Application Priority Data

Aug. 16, 1997 (GB) ..... 9717361

(51) Int. Cl.[7] ..... E21B 31/107
(52) U.S. Cl. ..... 166/178; 175/299
(58) Field of Search ..... 175/299; 166/178

(56) References Cited

U.S. PATENT DOCUMENTS

| | | | | |
|---|---|---|---|---|
| 4,194,582 | * | 3/1980 | Ostertag | 175/321 |
| 4,846,273 | * | 7/1989 | Anderson et al. | 166/178 |
| 5,425,430 | * | 6/1995 | Roberts | 175/296 |
| 5,918,689 | * | 7/1999 | Roberts | 175/297 |

FOREIGN PATENT DOCUMENTS

| | | |
|---|---|---|
| 2 210 082 A | 6/1989 | (GB) . |
| 2 283 259 A | 5/1995 | (GB) . |
| 2 285 996 A | 8/1995 | (GB) . |
| 93/04258 | 3/1993 | (WO) . |

* cited by examiner

*Primary Examiner*—Hoang Dang
(74) *Attorney, Agent, or Firm*—Ratner & Prestia

(57) ABSTRACT

A double acting jar enhancer tool is capable of storing energy to enhance both upward and downward impacts delivered by a drilling jar. The enhancer stores energy in a single energy storage stack, typically of either bellville washer springs or a coil spring, and stores the energy in the storage stack irrespective of which direction it is moved, obviating separate energy storage stacks for upward and downward blows.

17 Claims, 17 Drawing Sheets

IMPACT ENHANCING TOOL

This application is the U.S. national phase application of PCT International Application No. PCT/GB98/02388 filed Aug. 7, 1998.

The present invention relates to an impact enhancing tool, and particularly, but not exclusively, relates to a double acting impact enhancing tool for inclusion in a string of tubulars, where a drilling jar is also included in the string.

During the drilling of boreholes for oil and/or gas wells the drill pipe may become stuck in the borehole during drilling and it is not possible to move the stuck pipe by normal upward pulling or downward pushing forces. In order to free the drill pipe it may be necessary to deliver jarring forces to the drill string. Hence, it is common practice to include a drilling jar in the drill string and a jar enhancer located above the jar, and separated from the jar by a number of lengths of drill pipe. When activated, the jar exerts an upwardly or downwardly directed jarring force on the stuck drill pipe.

Jars generally consist of an outer body member and an inner body member where one of the members is connected to the drill string below the jar and the other member is connected to the drill string above the jar. There is normally a hammer device on one of the members and an anvil on the other member. The outer body member and the inner body member are releasably connectable such that the hammer and the anvil are held in a spaced apart relationship, until tension or compression exerted on the jar exceeds a certain level. When this occurs, the outer body member and the inner body member are released and the hammer is free to travel upwardly to strike the anvil, thus exerting the impact force required to release the stuck object.

In order to enhance the jarring impact delivered by the jar, an enhancer may be used in conjunction with the jar. The enhancer is normally located in the drill string above the jar and is usually separated from the jar by drill pipe. The weight of drill pipe between the jar and the enhancer is used to enhance the impact force delivered by the jar. When the jar is released, a portion of the enhancer accelerates upwards (or downwards) so that the weight of drill pipe accelerated contributes to the jarring force produced by the jar.

Conventional enhancers comprise an inner and an outer member which are slidable with respect to one another, with the outer ends of the members being coupled to the drill pipe above and below the tool. An energy storing means such as a compressible fluid is disposed between, and acts between, the inner and the outer members. The energy storage means in double acting enhancers are normally split into two chambers, such that the enhancer can be used to enhance the impact of the jar both in the upwards and downwards direction. Examples of the conventional tools are shown in UK Patent No 2123880, EP Patent No 0314130, UK Patent Publication No 2285996, UK Patent Publication No 2283259 and UK Patent No 2210082. However, all these conventional tools require two chambers to house the energy storing means, which therefore increases their complexity, length and cost.

Another example of a conventional impact enhancing tool is shown in PCT International Publication No WO 93/04258 (International Application No PCT/U.S. Ser. No. 92/05618) as being a double acting accelerator having a compressible fluid located in a single fluid chamber. Energy can be stored in the compressible fluid when there is movement of the inner mandrel with respect to the outer housing in either axial direction. However, this conventional tool further requires two coiled springs (in addition to the single fluid chamber) in order to centralise the tool prior to the energy being stored in the compressible fluid. This is important so that the maximum stroke of the tool, in either axial direction of movement, can be achieved. Therefore, the additional two coiled springs result in extra complexity within the tool, with the result that there are extra components required. Further, with the requirement of a chamber to house the fluid, there is the resulting disadvantage that if the integrity of the chamber is compromised, then the tool is effectively inoperative.

According to the present invention, there is provided an impact enhancing tool having a long axis and comprising an outer body member; an inner body member axially movable in relation to the outer body member; and spring means, optionally disposed between the body members, such that movement of the inner body member in either axial direction with respect to the outer body member causes energy to be stored in the spring means.

Preferably, energy is stored in the spring means by compression thereof. Typically, the spring means is disposed in an annulus formed between the inner and outer body members.

Preferably, the spring means is disposed between an upper compression device located at one end of the spring means, and a lower compression device located at the other end of the spring means, and preferably, the upper and lower compression devices butt against the respective ends of the spring means. The spring means may comprise a single spring, or a stack of bellville washer springs or the like, or an array of springs arranged side by side or otherwise extending between two axially spaced points of the device.

The compression devices optionally comprise one or more elements slidable in the tool, and optionally provide a shoulder to abut the spring means.

Typically, movement of the inner body member into the outer body member moves the upper compression device with respect to the outer body member whilst the lower compression device remains stationary with respect to the outer body member. Typically, movement of the inner body member out of the outer body member moves the lower compression device with respect to the outer body member whilst the compression device remains stationary with respect to the outer body member.

Preferably, the inner body member comprises an upper coupling surface and a lower coupling surface for respective coupling with the upper and lower compression devices to effect movement of the upper or lower compression devices, with respect to the outer body member. More preferably, the upper and lower coupling surfaces are respective upper and lower radially outwardly projecting shoulders.

Preferably, the outer body member comprises an upper seating surface and a lower seating surface against which the respective upper and lower compression devices seat to prevent movement of the upper or lower compression devices, with respect to the outer body member. More preferably, the upper and lower seating surfaces are respective upper and lower radially inwardly projecting shoulders.

Preferably, the inner body member further comprises a stroke restraint device which restrains the inner body member from moving further than a known distance with respect to the outer body member.

Typically, the inner body member comprises an upper and a lower stroke restraint device which make contact with respective upper and lower stroke restraint devices mounted on the outer body member. Preferably, the upper and lower stroke restraint devices mounted on the outer body member are respective said upper and lower radially inwardly projecting shoulders.

An example of an impact enhancing tool will now be described, by way of example only, with reference to the accompanying drawings in which.

Figure 1:
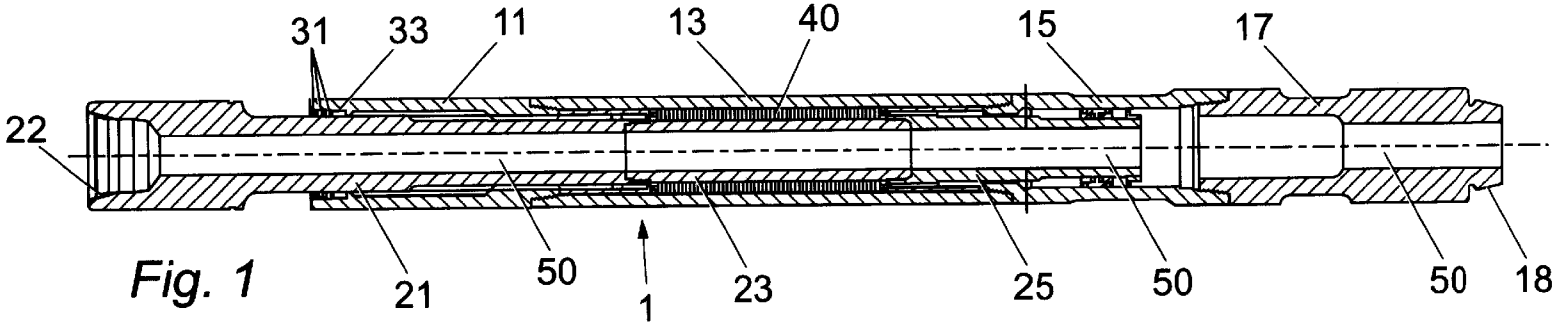
FIG. 1 is a cross-sectional side view of an enhancer tool in accordance with the present invention, in a mid point or neutral configuration.
Figure 14B:
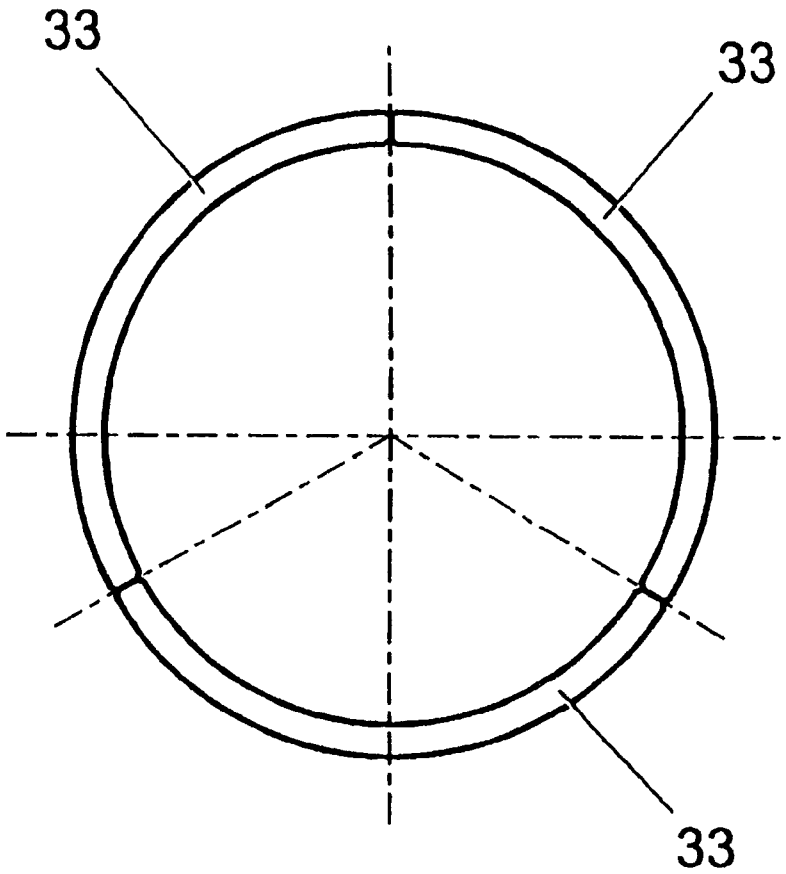
Figure 14A:
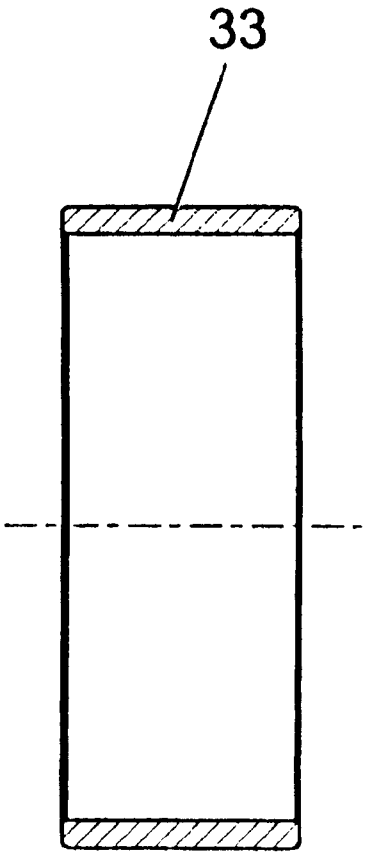

FIG. 14*a* is a cross-sectional side view of a female spline bearing of the tool of FIG. 1;

FIG. 14*b* is an end view of the female spline bearing of FIG. 14*a;*

Figure 15:
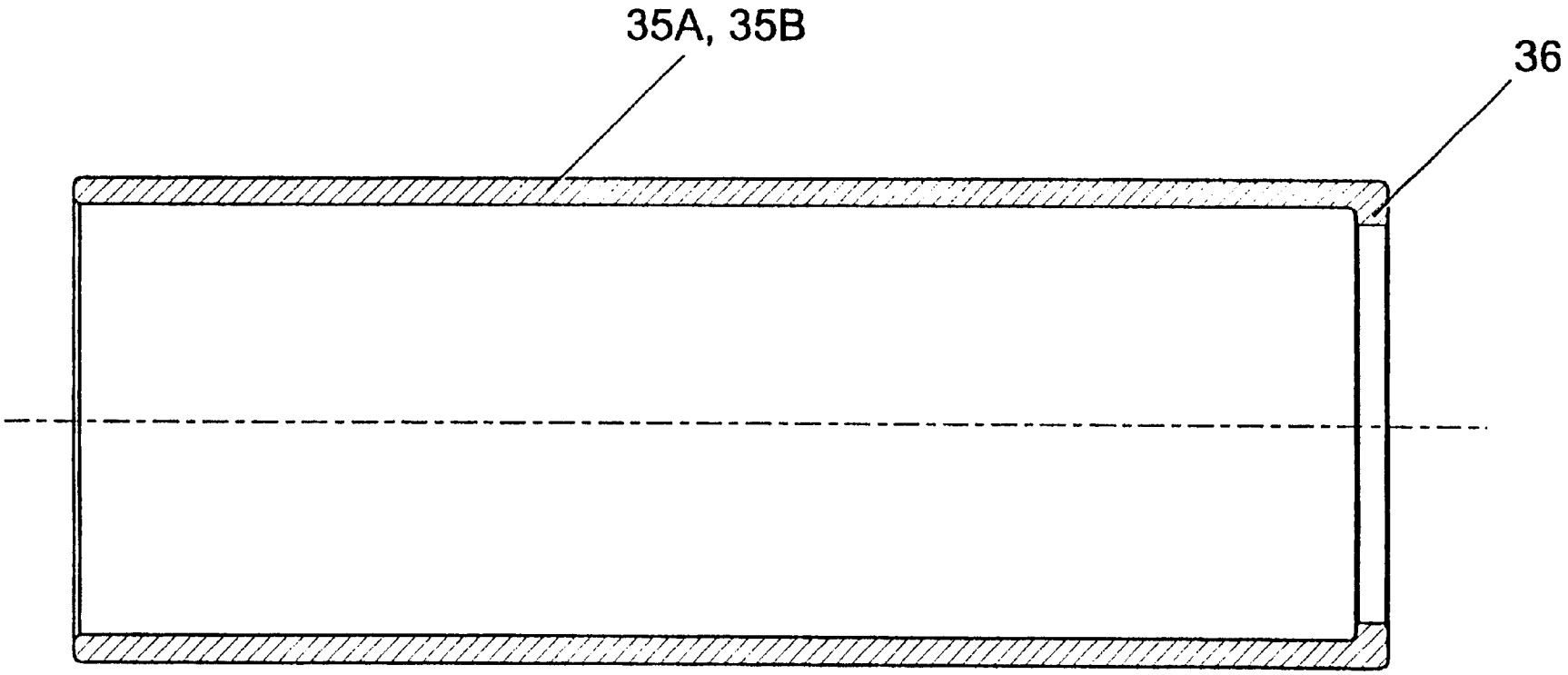
Figure 16B:
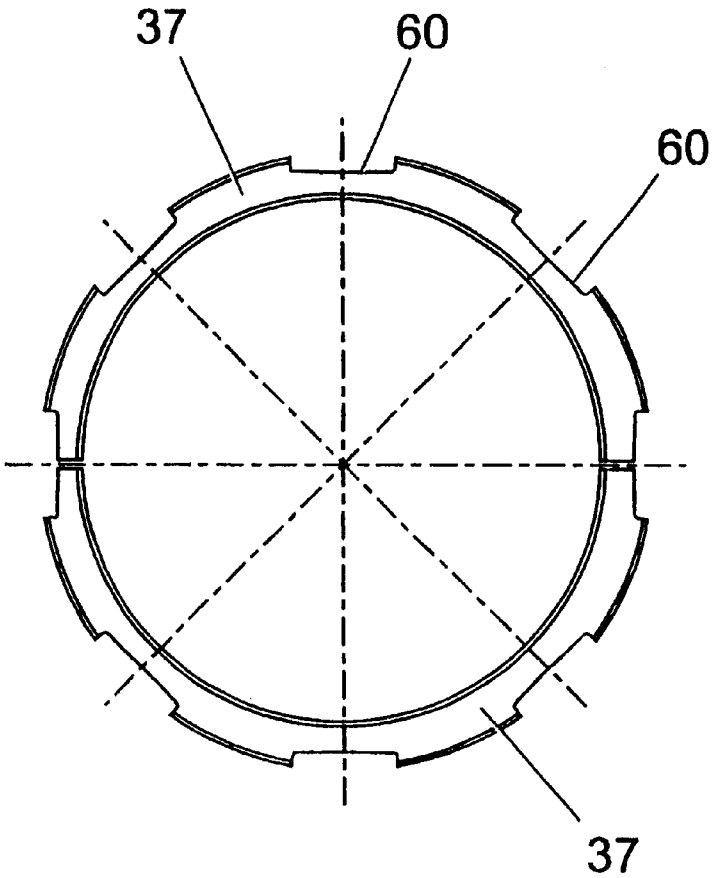
Figure 16A:
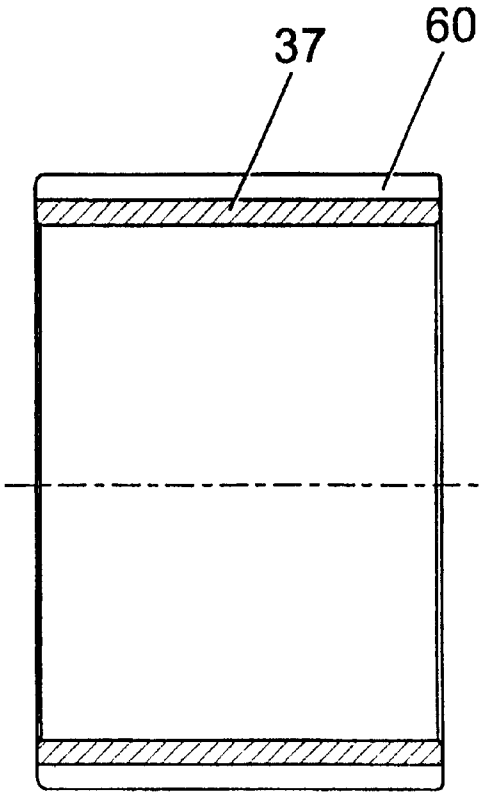

FIG. 15 is a cross-sectional side view of a spline bushing of the tool of FIG. 1;

FIG. 16*a* is a cross-sectional side view of a split bushing of the tool of FIG. 1;

FIG. 16*b* is an end view of the split bushing of FIG. 16*a;*

Figure 17C:
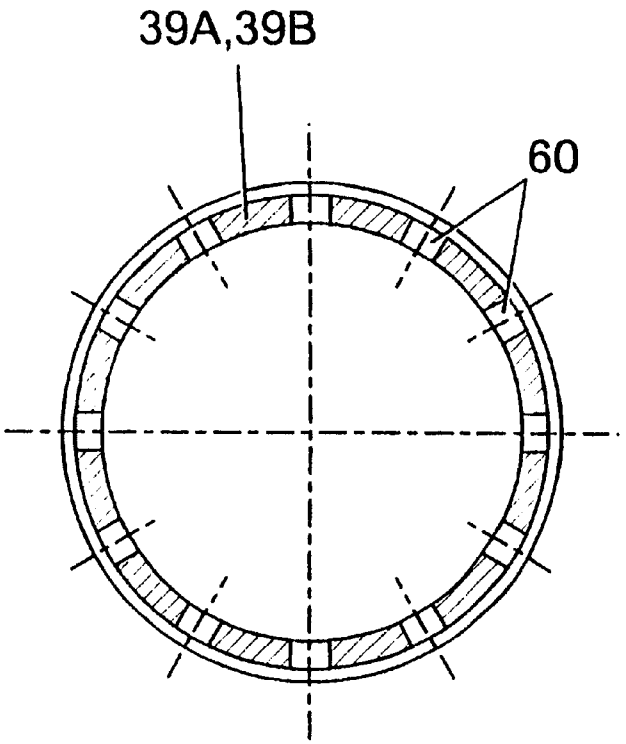
Figure 17B:
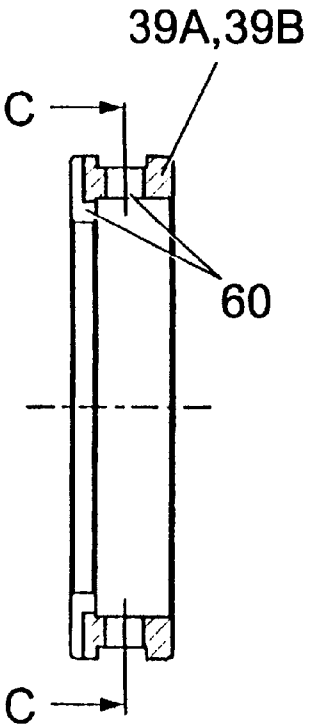
Figure 17A:
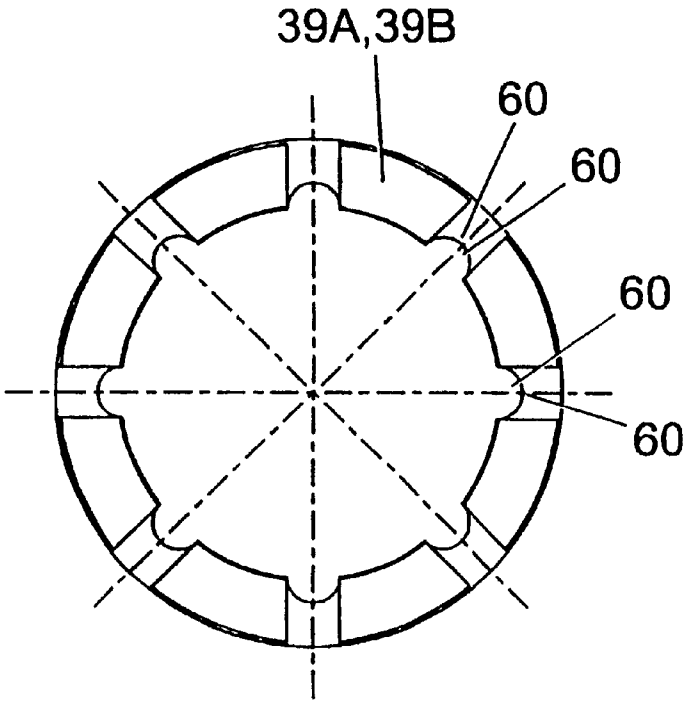

FIG. 17*a* is an end view of a bypass ring of the tool of FIG. 1;

FIG. 17*b* is a cross-sectional side view of the bypass ring of FIG. 17*a;*

Figure 18:
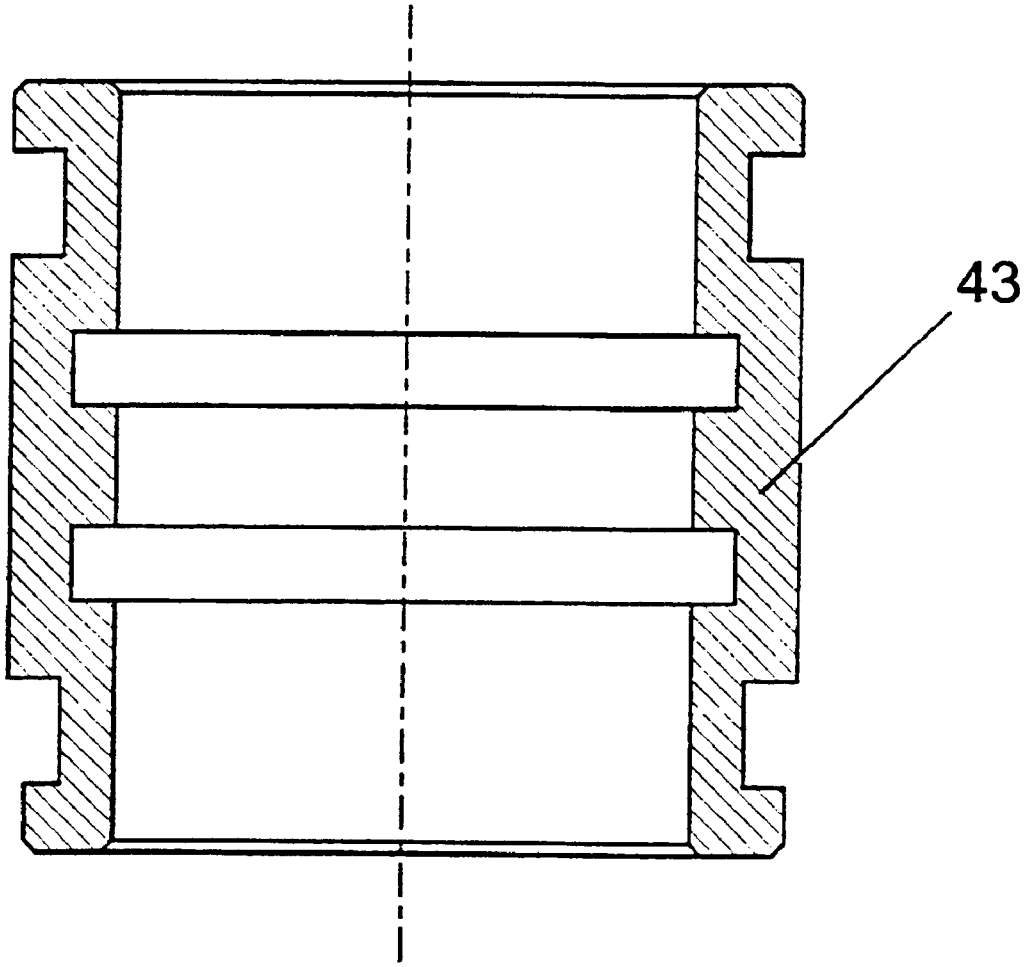
Figure 19B:
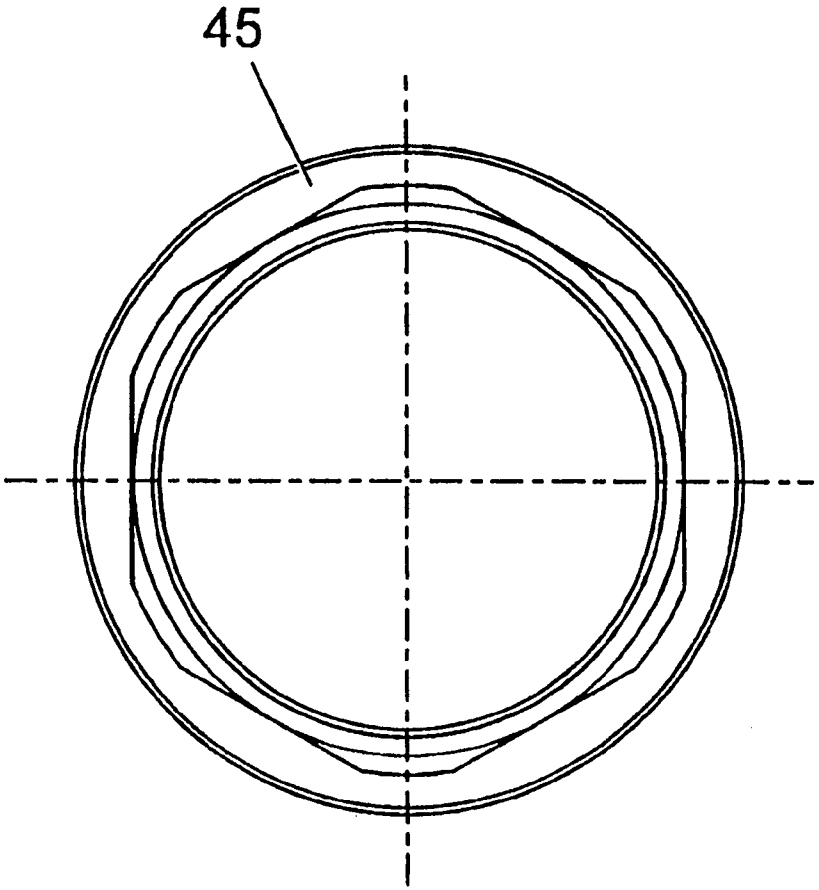
Figure 19A:
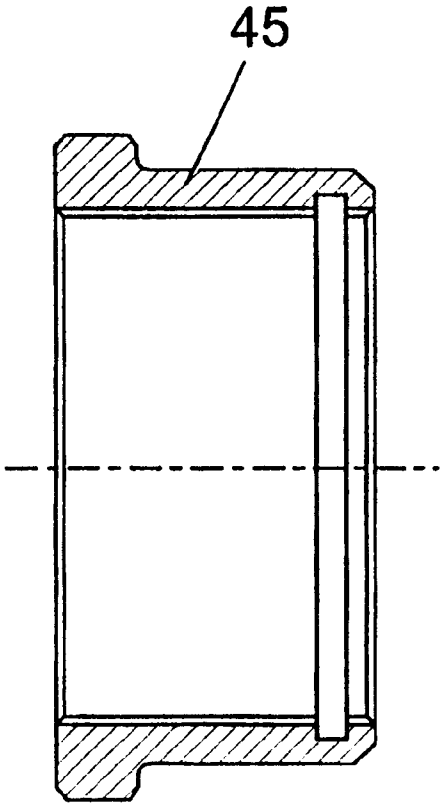

FIG. 17*c* is a cross-sectional end view of the bypass ring of FIG. 17*b* across section C—C;

FIG. 18 is a cross-sectional side view of a balance piston of the tool of FIG. 1;

FIG. 19*a* is a cross-sectional side view of a piston nut of the tool of FIG. 1; and FIG. 19*b* is an end view of the piston nut of FIG. 19*a*.

Figure 7:
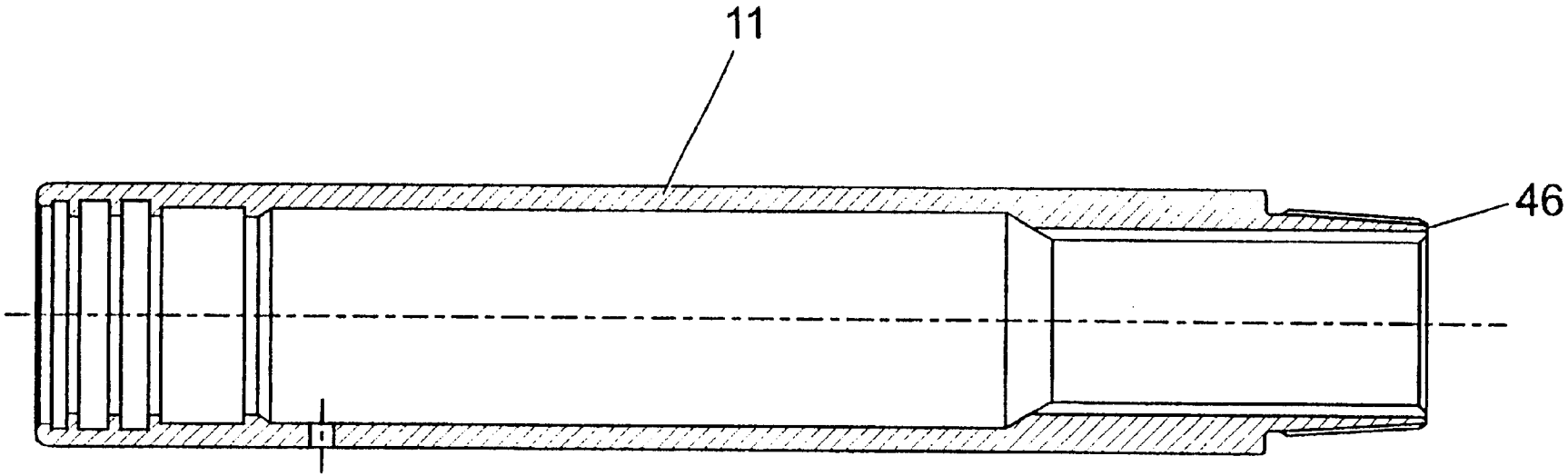
FIG. 7 is a cross-sectional side view of a female spline of the tool of FIG. 1.
Figure 8:
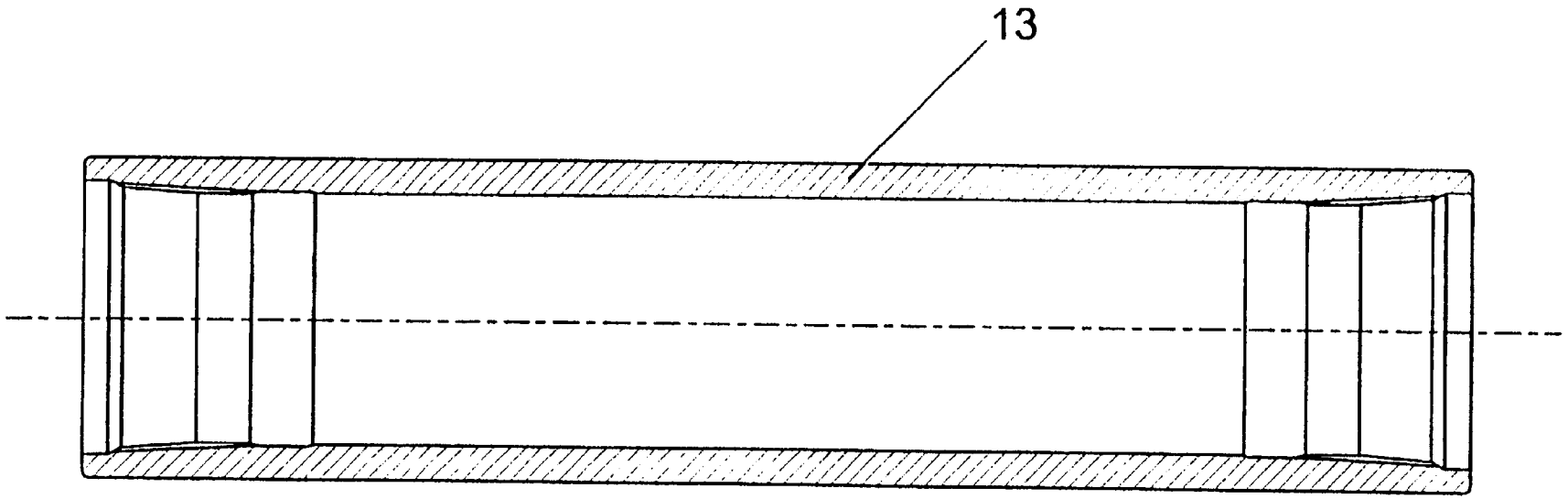
FIG. 8 is a cross-sectional side view of a spring housing of the tool of FIG. 1.
Figure 9:
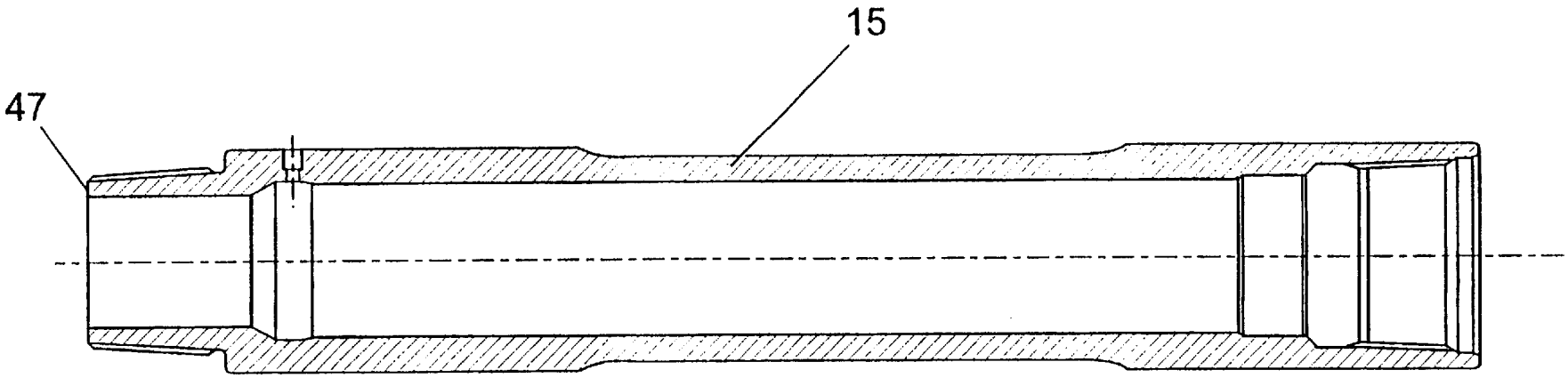
FIG. 9 is a cross-sectional side view of a balance housing of the tool of FIG. 1.
Figure 10:
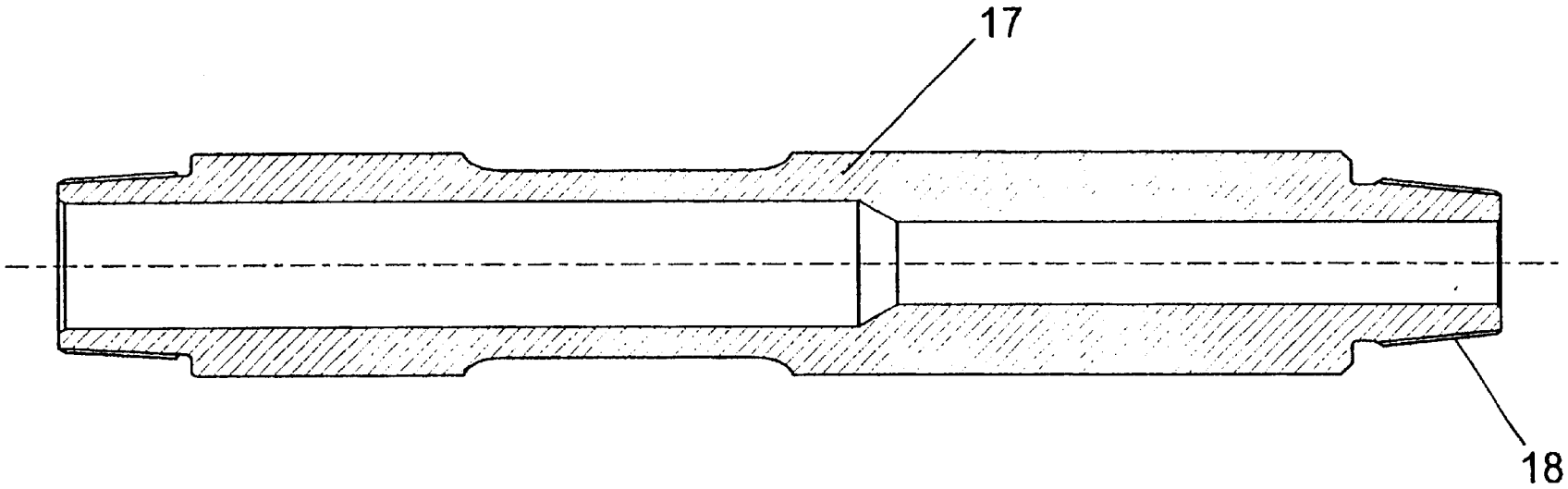
FIG. 10 is a cross-sectional side view of a bottom sub of the tool of FIG. 1.
Figure 11:
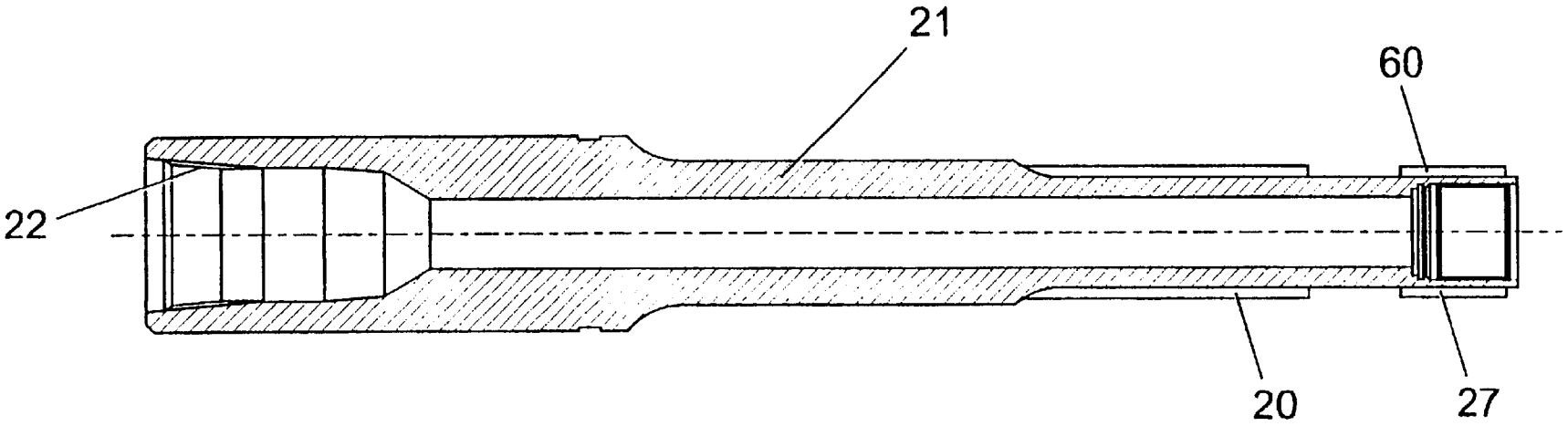
FIG. 11 is a cross-sectional side view of a male spline of the tool of FIG. 1.
Figure 12:
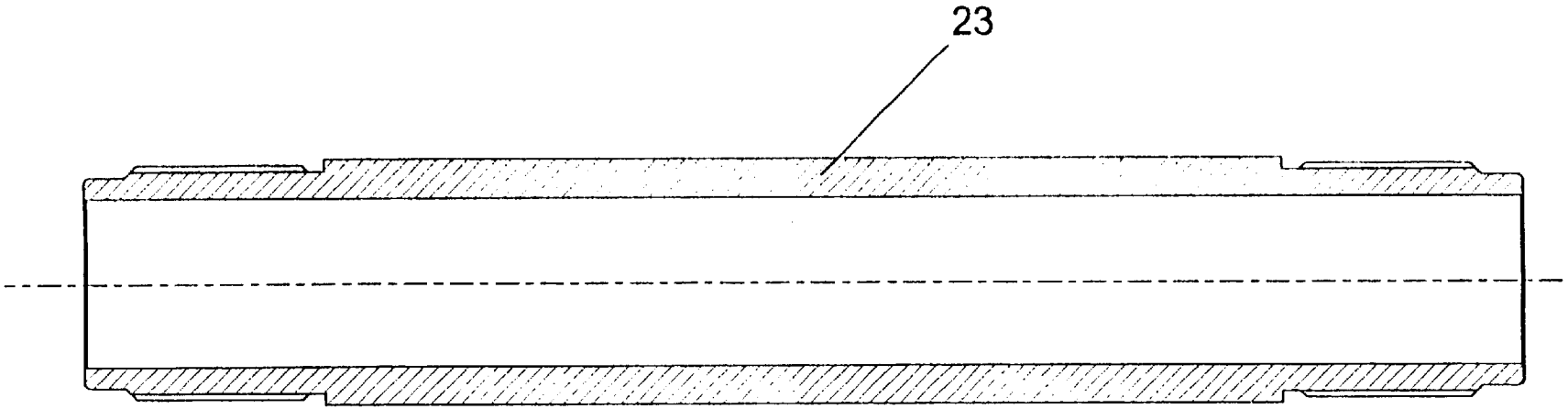
FIG. 12 is a cross-sectional side view of a spring mandrel of the tool of FIG. 1.
Figure 13:
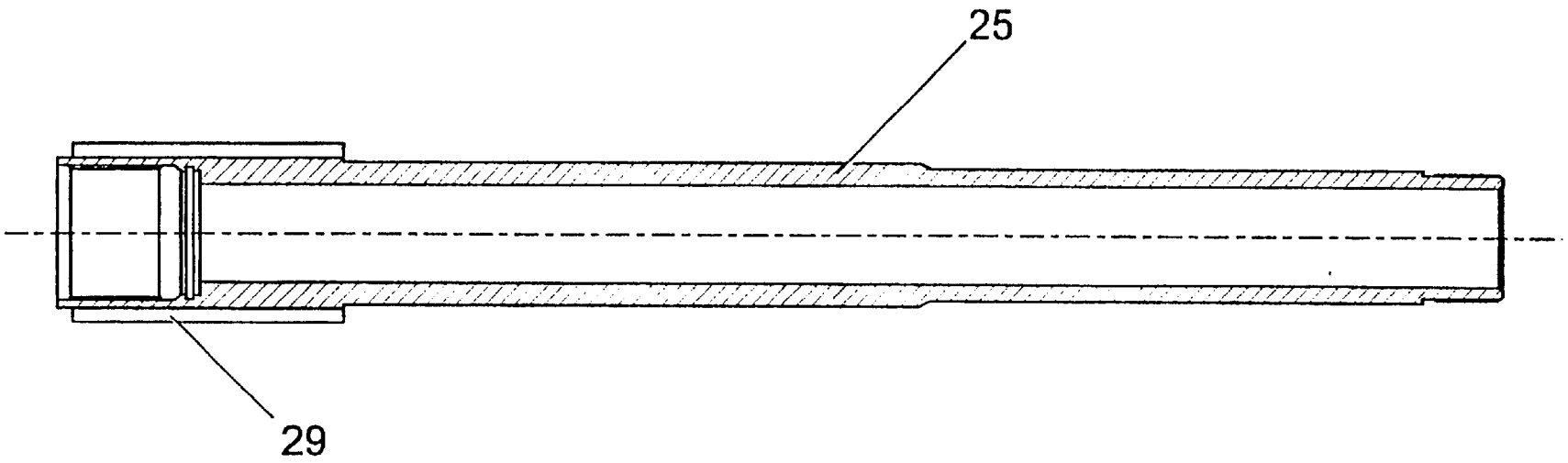
FIG. 13 is a cross-sectional side view of a wash pipe of the tool of FIG. 1.

An impact enhancing tool 1 is shown in FIG. 1 and comprises an outer or female body member 11, 13, 15, 17 and an inner or male body member 21, 23, 25. The female body member 11, 13, 15, 17 comprises a female spline 11 (also shown in FIG. 7) at its upper end, which is coupled at its lower end to a spring housing 13 (also shown in FIG. 8) which is further coupled at its lower end to a balance housing 15 (also shown in FIG. 9), which is further coupled at its lower end to a bottom sub 17 (also shown in FIG. 10). The male body member 21, 23, 25 comprises a male spline 21 (also shown in FIG. 11) which is coupled at its lower end to a spring mandrel 23 (also shown in FIG. 12) which is further coupled at its lower end to a wash pipe 25 (also shown in FIG. 13).

A conventional pin connection 18 is formed on the lower end of the bottom sub 17, and a conventional box connection 22 is formed on the upper end of the male spline 21, such that the tool 1 can be included in a drill string (not shown) at a location above a drilling jar tool (not shown), with the enhancer tool 1 and the drilling jar tool being separated by a number of lengths of drill pipes (not shown) and collars (not shown).

A bellville spring stack 40 is located in the annulus between the male and female body members, and provides a means of storing energy which can be used to enhance both up and down jarring.

The tool 1 shown in FIG. 1 is at the mid point or neutral configuration, that is with no compression being applied to the stack of bellville springs 40.

Figure 4:
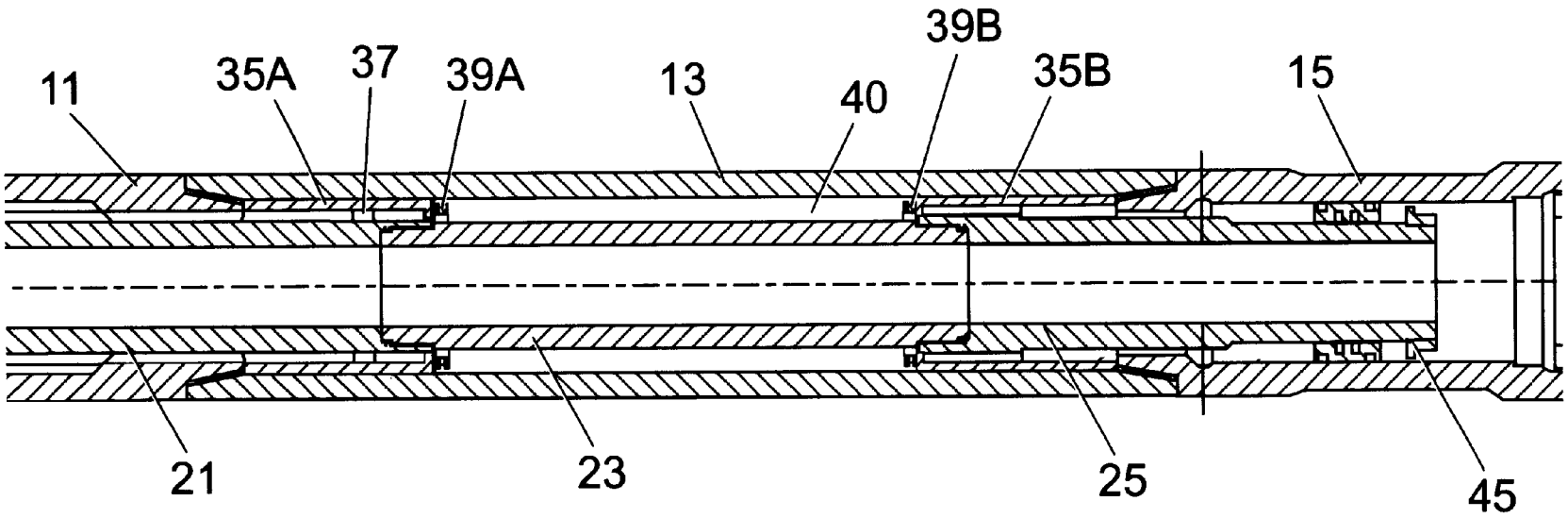
FIG. 4 is a cross-sectional side view of the middle portion of the tool of FIG. 1, in greater detail.
Figure 5:
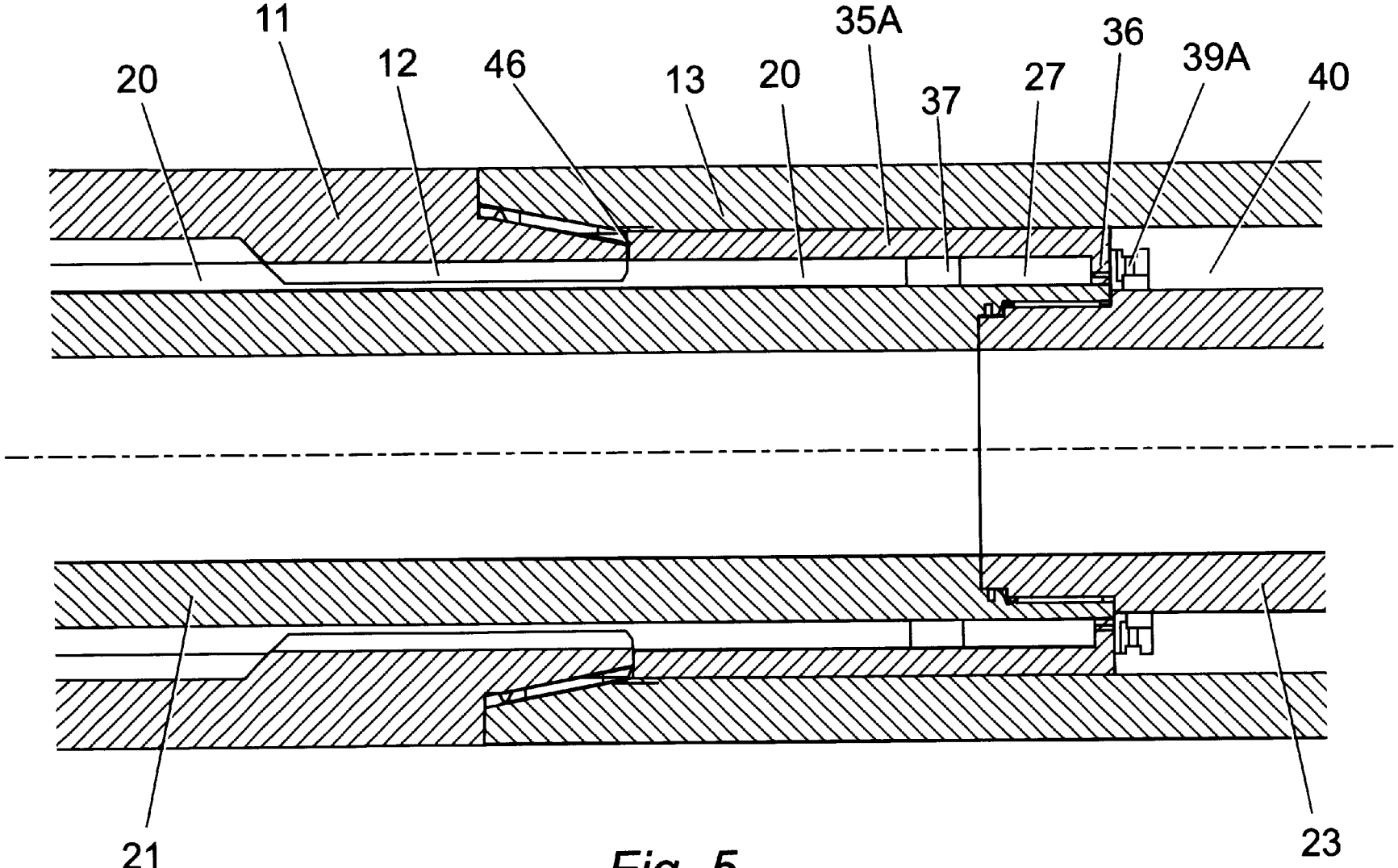
FIG. 5 is a cross-sectional side view of the upper part of the middle portion of the tool shown in FIG. 4, in greater detail.
Figure 6:
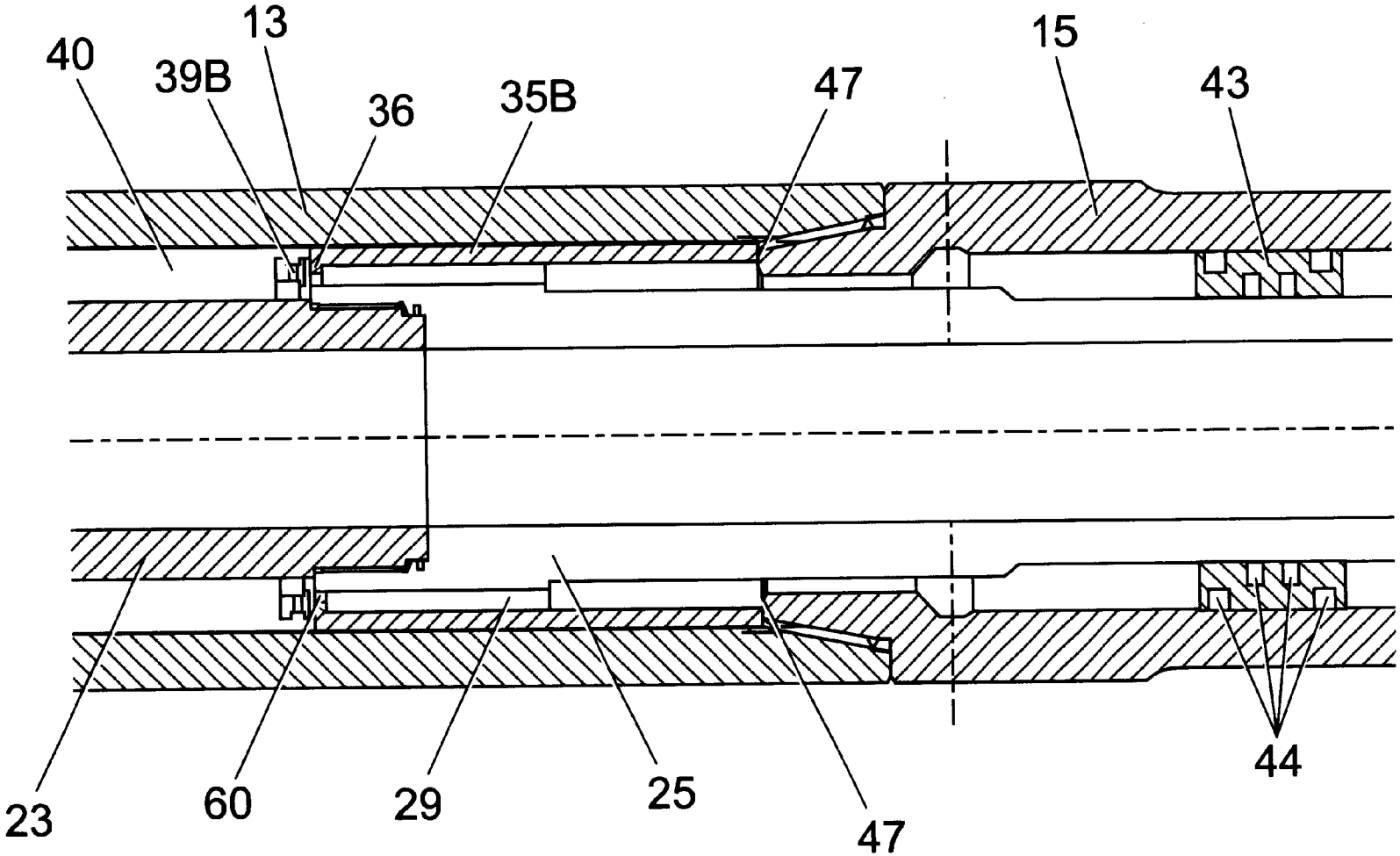
FIG. 6 is a cross-sectional side view of the lower part of the middle portion of the tool shown in FIG. 4, in greater detail.

The middle portion of the tool 1 can be seen in greater clarity in FIG. 4, and in even greater clarity in FIGS. 5 and 6 (with the bellville springs 40 not shown). The female spline 11 has inwardly projecting splines 12 which co-operate with outwardly projecting splines 20 mounted on the male spline 21. The co-operation of the respective splines 12, 20 ensure that longitudinal movement between the female and male body members is permitted, but rotational movement between the female and male body members is restrained.

A set of seals 31 mounted at the upper end of the female spline 11 restrain fluid outwith the tool 1 from entering the annulus between the female and male body members. A female spline bearing 33 (also shown in FIGS. 14*a* and 14*b*), which is typically formed from aluminium bronze, ensures free running in the longitudinal direction between the female and male body members.

Referring to FIG. 5, an upper cylindrical spline bushing 35A (also shown in FIG. 15) is located around the lower end of the male spline 21. The upper end of the upper spline bushing 35A butts against an inwardly projecting shoulder 46 at the lower end of the female spline 11. The lower end of the upper spline bushing 35A lip 36 which projects inwardly from the lower end thereof, below the lowermost end of a number of outwardly projecting blades 27 which are mounted on, and circumferentially spaced around, the lower end of the male spline 21. The blades 27 are circumferentially spaced to provide fluid flow passages 60 therebetween, which will be explained subsequently. A groove is formed between the blades 27 and the outwardly projecting splines 20, and a split bushing 37 (see FIGS. 16*a* and 16*b*) is located in the groove.

An upper annular bypass ring 39A (see FIGS. 17*a*, 17*b* and 17*c*) is located between the upper end of the stack of bellville springs 40 and the lower face of the upper spline bushing 35A, and is butted therebetween.

The lower end of the stack of bellville springs 40 is shown in FIG. 6 as butting against a lower annular bypass ring 39B, which further butts against a lower cylindrical spline bushing 35B. The lower spline bushing 35B and lower bypass ring 39B components are identical to those of the respective upper spline bushing 35A and upper bypass ring 39A, but are arranged in the opposing direction. The lower spline bushing 35B is located around the upper end of the wash pipe 25, such that the underside of lip 36 fits over the top ends of outwardly projecting and circumferentially spaced blades 29 on the upper end of the wash pipe 25. The lower end of the lower spline bushing 35B abuts against an inwardly projecting shoulder 47 at the upper end of the balance housing 15.

A balance piston 43 has an arrangement of seals 44 and is slidably mounted on the lower end of the wash pipe 25, and seals between the wash pipe 25 and the balance housing 15. The balance piston 43 is retained on the lower end of the wash pipe 25 by a piston nut 45 which is screwed onto the end of the wash pipe 25. Hydraulic fluid is located in the annulus between the male and female body members and is retained therein by the arrangement of seals 31 and the balance piston 43. The hydraulic fluid is free to flow around the stack of bellville springs 40, and the moving components of the tool 1 since the outer circumference of the spring mandrel 23 has a hexagonal cross-section, and the bypass rings 39A, 39B, spline bushings 35A, 35B and the blades 27, 29 have fluid flow passages 60. The balance piston 43 ensures pressure equalisation between drilling fluid located in a central bore 50 of the tool 1 and the hydraulic fluid.

Figure 2:
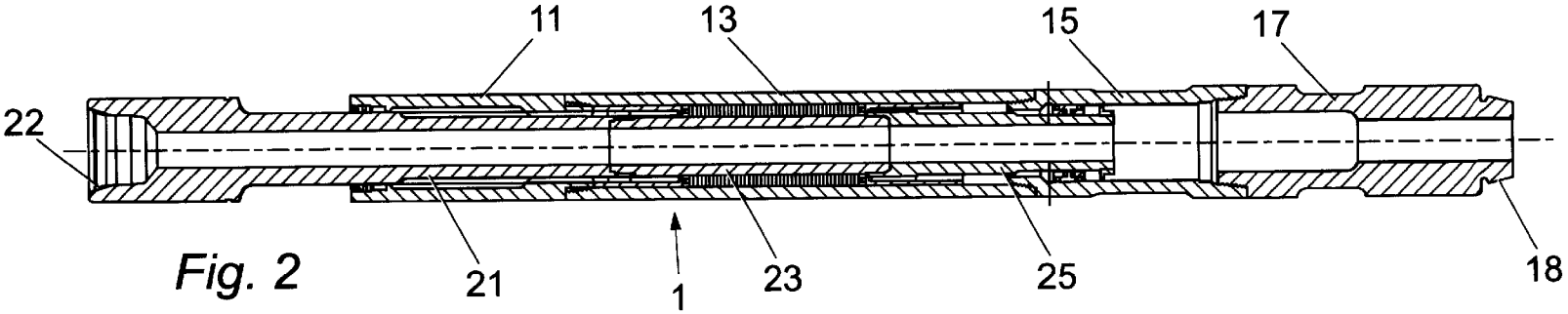
FIG. 2 is a cross-sectional side view of the tool of FIG. 1, in an open or stretched configuration.

When upward jarring is required, the male member 1 is pulled upward by exerting an upward pulling force on the upper end of the drill string. The blades 29 pull the lower spline bushing 35B and the lower bypass ring 39B upwards which compresses the stack of bellville springs 40 since the upper spline bushing 35A is restrained from movement by the shoulder 46 on the female spline 11. The male body member continues its upward movement until the split bushing 37 makes contact with the shoulder 46 whereby the male body member is restrained from any further upward movement. The configuration of the tool 1 is then as shown in FIG. 2. Thus, when the drilling jar is released, the energy stored in the stack of bellville springs 40 will accelerate the female body member upwards with respect to the male body member to enhance the jarring force of the drilling jar.

For downward jarring, weight is placed upon the male spline 21 which moves the male body member downwardly with respect to the female body member. This downward force is transferred to the upper spline bushing 35A by the blades 27 moving the upper bypass ring 39A downwardly and compressing the stack of bellville springs 40, since the lower spline bushing 35B is restrained from movement by the shoulder 47. This downward movement of the male body member continues until the lower ends of the blades 29 of the wash pipe 25 make contact with the shoulder 47. The downward movement of the male body member with respect to the female body member has now reached its limit, and the tool 1 is then in the configuration shown in FIG. 3. Thus, when the drilling jar is released, the downward jarring action thereof is enhanced by the release of the energy from the stack of bellville springs 40 which moves the female body member downwardly with respect to the male body member.

Figure 3:
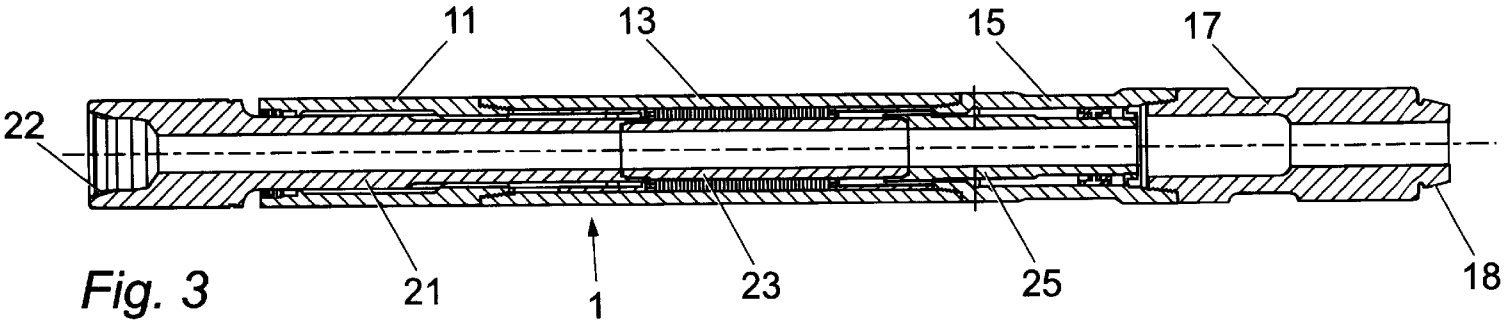
FIG. 3 is a cross-sectional side view of the tool of FIG. 1, in a closed or compressed configuration.

It is envisaged that certain embodiments of the tool will only achieve a full stroke such as that shown in FIGS. 2 and 3 at the extreme limits of use.

It should be noted that the stack of bellville springs 40 can be configured favourably in one direction, such as the downward direction, so that more energy is stored in the bellville springs 40 for the same stroke of the tool 1.

Therefore, the tool I has the advantages over the prior art in that only one stack of bellville springs 40 are required to firstly store the energy for either direction of enhancement for the jar, and secondly centralise the tool so that the maximum stroke in either direction is permitted. This has the advantage that the tool 1 is simplified in operation, and this advantage may be achieved by the provision of the two bushings 35A, 35B located at either end of the spring stack 40. Further, the provision of the bushings 35A, 35B simplifies the assembly of the tool 1, in that it is far simpler to insert the spring stack 40 between the female body member 11, 13, 15, 17 and the male body member 21, 23, 25. Further, the tool 1 stores energy in a single energy storage means (typically a single stack of bellville washer springs 40) irrespective of which direction it is moved, obviating separate energy storage means for upward and downward blows.

Modifications and improvements may be made to the embodiment described without departing from the scope of the invention. For instance, with modifications as neccesary, the tool 1 could be included in a coiled tubing string.

What is claimed is:

1. An impact enhancing tool, for enhancing the impact of a drilling jar tool, the impact enhancing tool having a long axis and comprising an outer body member; an inner body member axially movable in relation to the outer body member; and an annulus formed between the inner body member and the outer body member; and a single uninterrupted spring means disposed between the body members within the annulus such that movement of the inner body member in either axial direction with respect to the outer body member causes energy to be stored in the single spring means, such that the energy is releasable to enhance the impact of the drilling jar, wherein the energy is stored solely in the uninterrupted single spring means regardless of the axial direction of movement of the body members.

2. A tool as claimed in claim 1, wherein the spring means comprises a coil spring.

3. A tool as claimed in claim 1, wherein the spring means comprises bellville washer springs.

4. A tool as claimed in claim 1, wherein energy is stored in the spring means by compression thereof.

5. A tool as claimed in claim 1, wherein the spring means includes one or more compression device.

6. A tool as claimed in claim 5, wherein the spring means includes two compression devices disposed at respective ends of the spring means thereof.

7. A tool as claimed in claim 6, wherein movement of the inner body member into the outer body member moves an upper compression device while a lower compression device remains stationary with respect to the outer body member.

8. A tool as claimed in claim 6, wherein movement of the inner body member out of the outer body member moves a lower compression device with respect to the outer body member while an upper compression device remains stationary with respect to the outer body member.

9. A tool as claimed in claim 6, wherein the inner body member comprises an upper surface and a lower surface to engage the upper and lower compression devices.

10. A tool as claimed in claim 9, wherein the surfaces are shoulders to move the upper or lower compression devices with respect to the outer body member.

11. A tool as claimed in claim 9, wherein the upper and lower surfaces are respective upper and lower radially outwardly projecting shoulders.

12. A tool as claimed in claim 6, wherein the outer body member comprises an upper seating surface and a lower seating surface against which the respective upper and lower compression devices seat to prevent movement of the upper or lower compression devices with respect to the outer body member.

13. A tool as claimed in claim 12, wherein the upper and lower seating surfaces are respective upper and lower radially inwardly projecting shoulders.

14. A tool as claimed in claim 1, having a stroke restraint device which restrains the inner body member from moving further than a known distance with respect to the outer body member.

15. A tool as claimed in claim 14, wherein the inner body member comprises an upper and a lower stroke restraint device which can engage respective upper and lower stroke restraint devices on the outer body member.

16. A tool as claimed in claim 15, wherein the upper and lower stroke restraint devices on the outer body member are respective said upper and lower radially inwardly projecting shoulders.

17. A tool as claimed in claim 1, wherein the annulus is bounded at an end thereof by a balance piston, and wherein the annulus including the single uninterrupted spring means disposed therein is further provided with lubricating fluid disposed therein, such that the balance piston ensures pressure equalisation between fluid located outwith the annulus and the lubrication fluid contained within the annulus.

* * * * *